United States Patent [19]

Morello

[11] Patent Number: 4,957,312

[45] Date of Patent: Sep. 18, 1990

[54] SALES RECORDS

[75] Inventor: Peter S. Morello, 3 Stafford St., Unit 2, Plymouth, Mass. 02360

[73] Assignee: Peter S. Morello, Plymouth, Mass.

[21] Appl. No.: 447,380

[22] Filed: Dec. 7, 1989

[51] Int. Cl.[5] ..... B42D 15/00

[52] U.S. Cl. ..... 283/89; 283/67

[58] Field of Search ..... 400/237, 240.3; 283/88, 283/89, 67, 114, 67, 117, 95, 53, 54, 55, 56, 57, 72; 281/2, 5, 28, 51

[56] References Cited

U.S. PATENT DOCUMENTS

| | | | |
|---|---|---|---|
| 776,515 | 12/1904 | Ives | 283/89 |
| 1,144,742 | 6/1915 | Todd et al. . | |
| 1,428,278 | 9/1922 | Dow . | |
| 2,300,787 | 11/1942 | Ingliss | 283/114 |
| 3,048,697 | 8/1962 | Cavanaugh et al. | 283/89 |
| 3,332,827 | 7/1967 | Avery | 400/237 |
| 3,578,136 | 5/1971 | Postal | 400/237 |
| 3,858,705 | 1/1975 | Retiano | 197/172 |
| 3,861,305 | 1/1975 | Sasaki | 400/237 |
| 4,009,892 | 3/1977 | Nickerson | 283/67 |
| 4,175,776 | 11/1980 | Ranauro | 283/58 |
| 4,188,139 | 2/1980 | Pasini et al. | 400/237 |
| 4,234,214 | 11/1980 | Lee | 283/114 |
| 4,234,214 | 11/1980 | Lee | 283/57 |
| 4,277,514 | 7/1981 | Sugiura et al. | 427/1 |
| 4,511,616 | 4/1985 | Pitts et al. | 283/114 |
| 4,523,777 | 6/1985 | Holbein et al. | 283/114 |
| 4,636,844 | 12/1986 | Troy et al. | 283/67 |
| 4,668,597 | 5/1987 | Merchant | 283/67 |
| 4,689,018 | 8/1987 | Trinity | 283/67 |
| 4,797,016 | 1/1989 | Lahr | 400/237 |

FOREIGN PATENT DOCUMENTS

| | | | |
|---|---|---|---|
| 58-89377 | 5/1983 | Japan | 400/124 |
| 1154799 | 6/1989 | Japan | 283/89 |
| 323936 | 10/1957 | Switzerland | 283/114 |
| 440835 | 1/1936 | United Kingdom . | |

OTHER PUBLICATIONS

Digital Color Printer: IBM Technical Disclosure Bulletin: vol. 21, No. 5, Oct. 1978, Skinner and Shaeffer.

Multicolor Printing: IBM Technical Disclosure Bulletin: vol. 22, No. 7, Dec. 1979, Baker and Dunn.

*Primary Examiner*—Douglas D. Watts

*Assistant Examiner*—Thomas Hamill, Jr.

*Attorney, Agent, or Firm*—David Bennett

[57] ABSTRACT

Sales records comprising alphanumeric characters that are resistant to counterfeiting can be made by printing different parts of at least some of the characters making up the record in a plurality of colors.

7 Claims, No Drawings

SALES RECORDS

This invention relates to sales records and specifically to records that resist counterfeiting and thereby reduce a retailer's losses arising from the illegal use of such counterfeit records.

BACKGROUND OF THE INVENTION

It is a common practice in many large stores for purchases to be made on the basis of stock items on display in the store. The buyer selects his purchase, pays the sales person and receives a sale record. This record is then taken to a central supply counter where an item corresponding to that purchased is recovered from the store warehouse. With conventional sales records, anyone gaining access to blank sales record paper, which is often little more than a roll of plain paper, can print their own sales record and use it to claim any desired item at the supply counter. Each year many thousands of dollars worth of merchandise are stolen in this way. A further variation of this scheme is used where payment for the goods is made at the supply counter. A fraudulently printed sales record is used to obtain the item for an amount significantly lower than its actual retail price in the store.

Another fraudulent means of using illegally printed sales records involves using such a record to "legitimize" disposal of stolen merchandise. Using the record the stolen goods are "returned" to a retailer in exchange for a "refund" of the purchase price or traded for goods of equal value.

Losses flowing from these and many other similar schemes for cheating a retailer have led to an urgent need to develop a means of combatting such fraud. Of course it is possible to develop sophisticated registers, perhaps printing on more secure paper. However, this can be a very expensive solution. In most cases the retailer has invested significant amounts of money in his present sales record printers and is reluctant to purchase replacement printers at further expense.

The use of paper that is more difficult to obtain will perhaps reduce the problem, but suppliers of such paper would be required to cooperate to ensure that no supplies reached unauthorized hands. This degree of cooperation and security is difficult to achieve in practice and would be unlikely to have long-term success. Sales record paper is conventionally supplied in a roll of several feet in length. One stolen roll can therefore be used to print a very large number of fraudulent records.

It is clear therefore that there exists an urgent need for a method of reducing the ease of counterfeiting sales records that can be readily adapted to existing equipment. Because the stores targeted by operators of the schemes described above tend to operate on low margins, it is desirable that a successful method should involve minimal extra expenditure on the part of the retailer. It should, however, be flexible enough to permit variations that will enable the retailer to stay ahead of any attempts to defeat the system.

These objectives and others are met by the method of the present invention which provides a low cost, but effective technique for maintaining the integrity of current sales records providing systems.

DESCRIPTION OF THE INVENTION

The present invention provides a method of printing a sales record comprising a plurality of alphanumeric characters describing the details of the purchase in which different parts of at least some of said characters are printed in different colors. The term "alphanumeric" is used herein to refer to alphabet letters and geometric numbers, characters, or symbols as well as any combination of these that might be used to describe a purchase on a sales record.

Most existing sales record machines rely on impact printing in which a character is formed on a paper base as a result of the impact of a printing head upon an intermediate strip and the resultant transfer of an impression of the shape on that head to a substrate paper. In the simplest form, this could be a head bearing a raised character striking an inked ribbon and creating an imprint of that character on the paper in ink transferred from the ribbon. This is of course similar to the technique used in an old fashioned typewriter. More modern techniques use a dot matrix system in which closely spaced pins on the print head are selected in specific combinations to rise and strike an intermediate ribbon and thus, transfer a pattern of ink dots, which correspond to the desired character, to a substrate paper.

Other printing techniques that rely on the transfer of ink from a reservoir, such as an inked ribbon, to a surface in the pattern of the desired alphanumeric character can also be used in the method of this invention.

DESCRIPTION OF PREFERRED EMBODIMENTS

For the purpose of simplicity the present invention will be described in more detail with reference to a dot matrix printer. This is not, however, to be understood as implying any limitation on the essential concept of the invention which is readily adaptable to a range of printing techniques.

A dot matrix printer can readily be converted to operate according to the method of the invention by installation, in place of the usual monochrome print ribbon, a ribbon which is split lengthwise i.e. in the direction of advance, into two or more different colors. This split ribbon may be so located that the top half of a character is printed in one color and the lower half is printed in a different color. In some cases it might be feasible to have three contiguous lengthwise strips of three different colors or two similarly colored strips separated by a third strip of a different color.

The ribbon need not be color-slpit into equal strips or even into strips of constant width through this is often preferred. The division into a plurality or different colors need not extend the full length of the ribbon, but can be intermittent provided that, in any one sales record, some at least of the alphanumeric characters will have been partly printed in one color and partly printed in another color.

Since some print ribbons of the multiple-use type are in the form of mobius strips, it will be appreciated that the physical orientation of the color bands in the first pass will be reversed on the second pass and this provides an added means of making counterfeiting more difficult. In addition, the identity of the colors can be changed along the length of the ribbon so that a thief would have to ensure that they had met not only the right record format, but also the correct colors for the transaction sought to be counterfeited.

It should further be noted that while conventional sales record strips can be printed using a home computer, the split-color ribbons used in the method of the invention. Thus, to create any sales record of the type produced by the method of the invention would require access to an appropriate machine. Since this access is fairly easy to restrict, the security of the ribbon or paper supply is a relatively unimportant matter.

Since the inks on the ribbon strips are in contact along their contiguous edges, it is highly preferred that the inks be incompatible. This can be done by ensuring that they are made up in non-compatible bases such as water and a mineral oil or wax. Other means will be apparent to those skilled in the art.

The method of the invention can be further varied by providing that different combinations of colors be used at different times. It is also possible to add to one or more of the inks in the colored ribbon portions, a component that is activated or observable only under specified conditions. For example, a component could be added that only becomes visible under ultraviolet illumination. In this way, even if a thief selected the correct colors, they could be thwarted by not having the ultraviolet detectable component present.

It will be apparent that the present invention is amenable to a wide range of adaptations beyond these described above so as to make the fraudulent creation of sales records even more difficult. It is to be understood that all such variations and modifications that do not depart from the based concept described above are within the purview of this invention.

What is claimed is:

1. A method of printing a sales record comprising a plurality of alphanumeric characters describing the sale to which the record pertains, which method comprises printing different parts of at least the majority of the characters in different colors and in which the characters are printed from ink carried on a ribbon that is automatically advanced during use and which is split in the direction of advance into contiguous split portions and carries different colors on the contiguous split portions of the ribbon.

2. A method according to claim 1 in which at least the majority of the alphanumeric characters are printed such that upper and lower portions of said characters are printed in different colors.

3. A method according to claim 1 which comprises printing contiguous portions of the same alphanumeric character in different colored inks that are non-compatible.

4. A method according to claim 1 which comprises printing the alphanumeric characters such that the proportion of each character printed in a given color is varied in a predetermined manner.

5. A method according to claim 1 which comprises changing the colors used to print the characters after a predetermined time or after a predetermined number of sales records have been issued.

6. A method according to claim 1 which comprises printing the alphanumeric characters using at least one ink that comprises a component that is invisible in normal light, but which can be rendered visible by irradiation with light of a suitable wavelength.

7. A method according to claim 1 which comprises printing using a dot-matrix printing system and a longitudinally-split ribbon with contiguous split portions of the ribbon having different colors.

* * * * *